US007011120B2

(12) United States Patent
Nakabayashi et al.

(10) Patent No.: US 7,011,120 B2
(45) Date of Patent: Mar. 14, 2006

(54) LIQUID FILLING DEVICE AND METHOD

(75) Inventors: Kenichi Nakabayashi, Tsurugashima (JP); Kimihiro Tanaka, Tsurugashima (JP); Kazuhiko Goto, Tsurugashima (JP)

(73) Assignee: Daisey Machinery Co., Ltd., Saitama-Ken (JP)

( * ) Notice: Subject to any disclaimer, the term of this patent is extended or adjusted under 35 U.S.C. 154(b) by 48 days.

(21) Appl. No.: 10/654,441

(22) Filed: Sep. 4, 2003

(65) Prior Publication Data

US 2004/0045630 A1 Mar. 11, 2004

(30) Foreign Application Priority Data

Sep. 5, 2002 (JP) ..... 2002-259917

(51) Int. Cl.
*B65B 1/04* (2006.01)

(52) U.S. Cl. ..... 141/302

(58) Field of Classification Search ..... 141/301, 141/302, 67; 222/450–453, 380
See application file for complete search history.

(56) References Cited

U.S. PATENT DOCUMENTS 3,850,345 A * 11/1974 Merritt ..... 222/168.5
4,437,498 A * 3/1984 Pankratz et al. ..... 141/89
4,877,160 A * 10/1989 Derving ..... 222/494
4,974,755 A * 12/1990 Sonntag ..... 222/309
5,108,014 A * 4/1992 Nordmeyer et al. ..... 222/380

* cited by examiner

*Primary Examiner*—Steven O. Douglas
(74) *Attorney, Agent, or Firm*—Wenderoth, Lind & Ponack, L.L.P.

(57) ABSTRACT

A liquid filling enables liquid, especially high consistency liquid, to be filled in a constant quantity without bubbles and without drops of the liquid. In the liquid filling device for receiving liquid into a cylinder and feeding it into a container, a three-way valve is provided for changing over between inflow and outflow of the liquid into and from the cylinder. A pouring port through which the liquid fed from the cylinder is poured into the container and a check valve on the pouring port to be opened by pressure of the liquid fed to the pouring port are also provided.

8 Claims, 2 Drawing Sheets

LIQUID FILLING DEVICE AND METHOD

BACKGROUND OF THE INVENTION

1. Field of the Invention

The present invention relates to a liquid filling device of a type to receive liquid into a cylinder and feed it into a liquid container, and also relates to a liquid filling method using this liquid filling device.

2. Description of the Prior Art

As a liquid filling device that fills a predetermined quantity of liquid into various kinds of containers, there is known a liquid filling device in which liquid is once received into a cylinder and then fed in a predetermined quantity into a liquid container. In this kind of liquid filling device, a check valve is opened and closed by pressure of the filling liquid so that the liquid in the cylinder is fed into the container.

In such a liquid filling operation using the check valve, a liquid that often contains bubbles in the upper portion of the cylinder is fed into the liquid container, so that there is caused a problem in filling a constant quantity of the liquid in each of the liquid containers. For example, if the liquid to be filled is of a high consistency so that bubbles are easily generated on the upper surface of the liquid, like soymilk to be filled in a Tofu (bean curd) container, the bubbles are easily filled in the Tofu container together with the soymilk, thereby inviting problems such as causing an overflow of the soymilk out of the container, deteriorating an external appearance of the solidified Tofu or causing a weight insufficiency of the filled Tofu.

Also in the prior art device, at the time of finishing the feeding of the filling liquid, cut-off of the liquid is insufficient and there is caused a problem of soiling the liquid filling device by drops of the liquid around the container like the Tofu container.

SUMMARY OF THE INVENTION

It is therefore an object of the present invention to provide a liquid filling device of a type to receive liquid into a cylinder and feed it into a liquid container, that allows liquid, especially a high consistency liquid, to be fed into a liquid container in a constant quantity of the liquid without entrained bubbles and without drops of the liquid.

It is also an object of the present invention to provide a liquid filling method using the above liquid filling device.

In order to solve the above-mentioned object, the present invention provides a liquid filling device of the type to receive liquid into a cylinder and feed it into a liquid container, wherein there is provided a three-way valve that effects a change-over between receiving the liquid into the cylinder and feeding the liquid into the liquid container from the cylinder.

According to the liquid filling device of the present invention constructed as mentioned above, the timing to feed the liquid in the cylinder into the liquid container is appropriately controlled by the opening and closing of the three-way valve, and the liquid can be filled in a constant quantity into each of the liquid containers.

Especially, at an initial stage of the step to feed the liquid in the cylinder into the liquid container, opening of the three-way valve to the liquid filling line side is slightly delayed. Thereby, the liquid that contains air or bubbles remaining in or on the upper surface portion of the liquid in the cylinder is first moved to a place other than the liquid container for removing the air or bubbles, and then the three-way valve is changed over so that an interior of the cylinder communicates with the liquid container and only the liquid from which air or bubbles are removed can be fed into the liquid container.

In this way, the timing to fill the liquid into the liquid container can be well adjusted by the operation of the three-way valve.

Also, in the liquid filling device according to the present invention, if the construction is made such that there are provided a pouring port through which the liquid fed from the cylinder is poured into the liquid container and a check valve on the pouring port which can be opened by pressure of the liquid fed to the pouring port, then it is very effective for preventing the liquid from dropping from the pouring port after the liquid is poured into the liquid container.

DESCRIPTION OF THE PREFERRED EMBODIMENTS

The invention will be described below more concretely based on an embodiment, as illustrated, of a liquid filing device according to the present invention.

Figure 1:
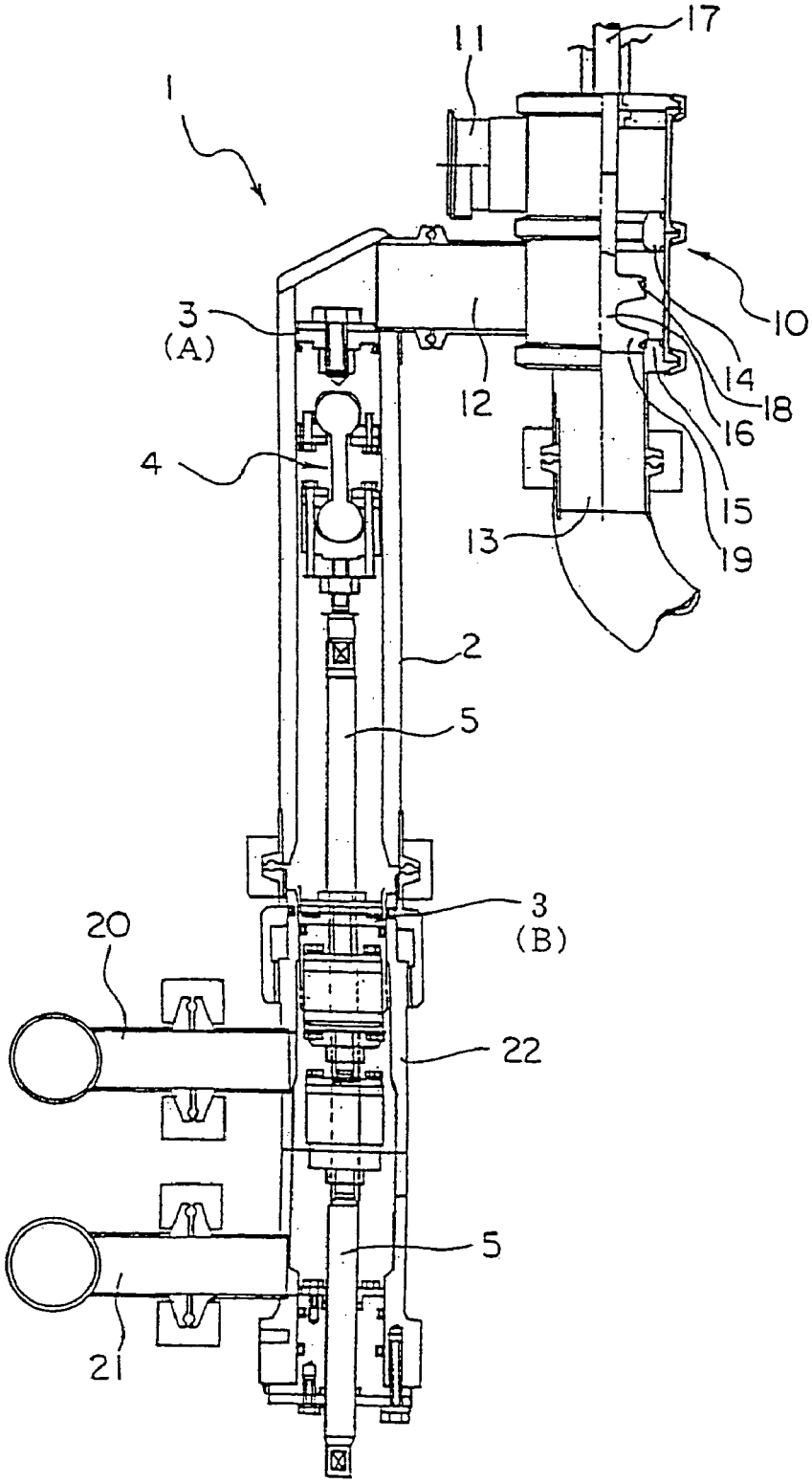
FIG. 1 is a longitudinal partial cross sectional view of an embodiment of a liquid filling device according to the present invention.

FIG. 1 shows a liquid filling device 1 that feeds a predetermined quantity of filling liquid, such as soymilk, into a liquid container. The liquid filling device 1 comprises a cylinder 2 that receives therein the liquid to first hold it and then feed it in a predetermined quantity into the liquid container. A piston 3 is provided within the cylinder 2 so as to be able to move up and down therein. As the piston 3 has a long stroke, it is connected to a piston rod 5 via a connecting link 4 so as to admit an axial eccentricity. The piston rod 5 is provided so as to be accurately moved up and down from below by a drive unit, such as a servomotor (not shown).

In FIG. 1, an ascent position (A) to which the piston 3 is moved up and a descent position (B) to which the piston 3 is moved down are shown. At the descent position (B) of the piston 3, the liquid is fed into the cylinder 2 (e.g., at a position above the ascent position of piston 3, as show in FIG. 1) and when the piston 3 is moved up to the ascent position (A) from the descent position (B), the liquid in the cylinder 2 is pushed out. In order to effect a change-over between receiving the liquid into the cylinder 2 and feeding the liquid into the liquid container from the cylinder 2, there is provided a three-way valve 10 at an upper end of the cylinder 2.

The three-way valve 10 comprises an inflow port 11 through which the filling liquid is received into the three-way valve 10 from a liquid supply source (not shown), an inflow and outflow port 12 that communicates with the upper end of the cylinder 2 and an outflow port 13 through which the filling liquid in the cylinder 2 is fed into the liquid container. Two valve seats 14, 15 are provided in the three-way valve 10, and also provided therein is a valve plug 16 so as to be moved up and down between the two valve seats 14, 15 by a valve rod 17. The valve plug 16 comprises two valves 18, 19, wherein the valve 18 seats on the valve seat 14 and the valve 19 on the valve seat 15.

If the valve plug 16 is moved down so that the valve 19 seats on the valve seat 15, the inflow port 11 and the inflow and outflow port 12 are caused to communicate with each other so that the filling liquid flowing in from the inflow port 11 can be received into the cylinder 2. If the valve plug 16 is moved up so that the valve 18 seats on the valve seat 14, the inflow and outflow port 12 and the outflow port 13 are caused to communicate with each other so that the liquid in the cylinder 2 can be fed to the outflow port 13.

A wash liquid inflow pipe 20 and a wash liquid outflow pipe 21 are fitted to the cylinder 2 at positions below the descent position (B) of the piston 3. The construction is made such that the filling liquid, such as soymilk, that leaks out from around the piston 3 to the connecting link 4 side is washed by wash liquid flowing in from the wash liquid inflow pipe 20 when the piston 3 is at the descent position (B), and is then discharged from the wash liquid outflow pipe 21 together with the wash liquid. Thereby, an interior of the cylinder 2 can always be maintained clean.

A cylinder 22 that is a portion of the cylinder 2 below the descent position (B) of the piston 3 has its inner diameter formed larger than an outer diameter of the piston 3, so that the portion of the connecting link 4 including the upper and lower portions thereof can be well washed.

Figure 2:
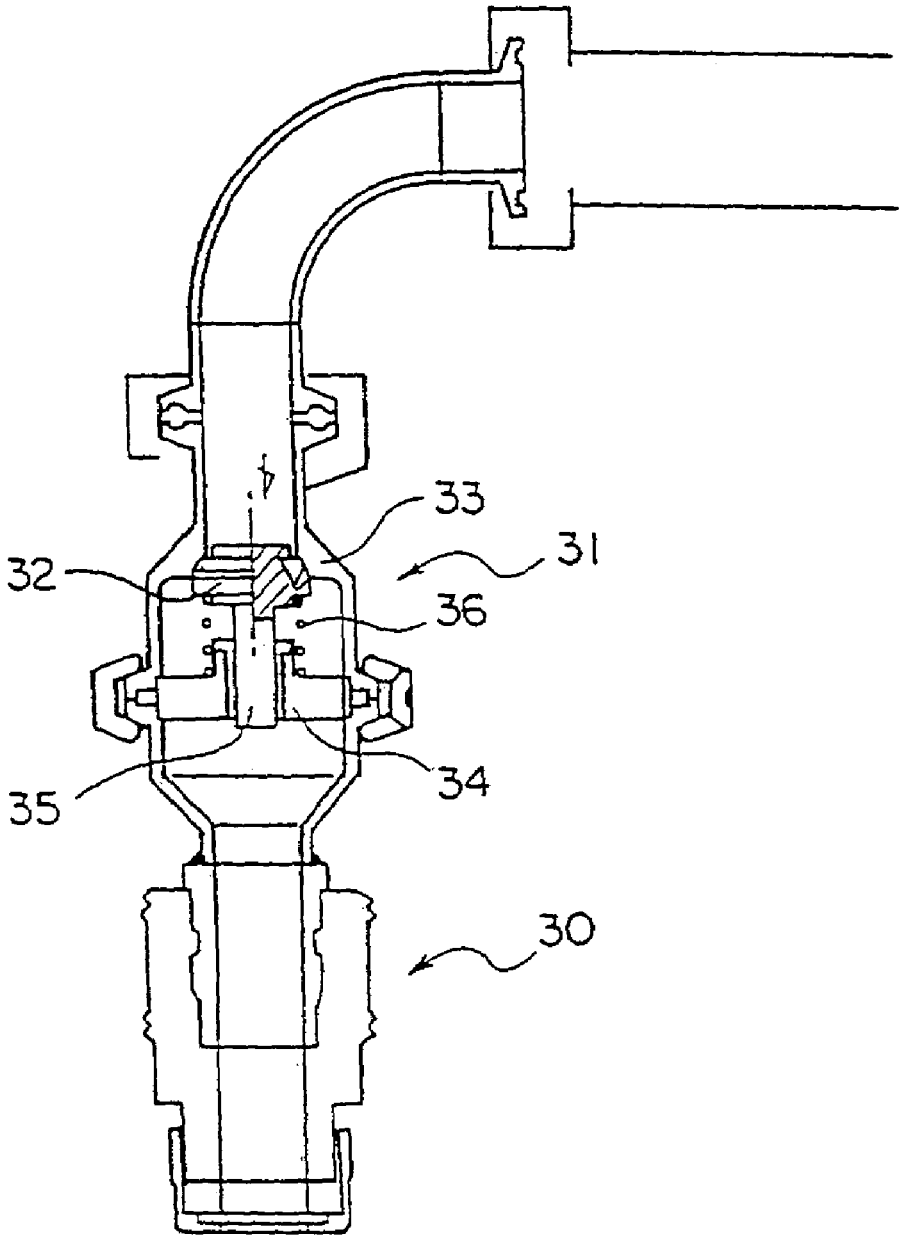
FIG. 2 is a longitudinal cross sectional view of a liquid pouring port of the embodiment of FIG. 1.

Downstream of the outflow port 13 through which the liquid in the cylinder 2 is fed to the liquid container, a pouring port 30 is provided, as shown in FIG. 2, so that the liquid is poured into the liquid container through the pouring port 30. A check valve 31, opened by pressure of the liquid fed to the pouring port 30, is provided on the pouring port 30. The check valve 31 is constructed to have a valve seat 33 so that a valve plug 32 seats on the valve seat 33. The check valve 31 has a valve plug holding plate 34 fixed within the check valve 31 and a valve rod 35 of the valve plug 32 is guided to move up and down along a guide hole provided in the valve plug holding plate 34.

The valve plug 32 is urged toward the valve seat 33 by a spring 36 arranged between the valve plug 32 and the valve plug holding plate 34.

In the check valve 31 constructed as mentioned above, when a supply pressure of the filling liquid to be supplied to the pouring port 30 exceeds an urging force of the spring 36, the valve plug 32 is pushed down to separate from the valve seat 33 so that the valve is opened and the filling liquid flows out of the pouring port 30. When the supply pressure of the liquid becomes lower than the urging force of the spring 36, the valve is closed and the outflow of the filling liquid stops.

In the liquid filling device constructed as illustrated and described, the liquid is filled into the liquid container as follows:

The valve plug 16 of the three-way valve 10 is first moved down so that the valve 19 seats on the valve seat 15. Thereby, the communication of the inflow port 11 and the inflow and outflow port 12 with the outflow port 13 is closed, and the communication between the inflow port 11 and the inflow and outflow port 12 is opened. In this state, the liquid to be filled is supplied from the inflow port 11 to be received into the cylinder 2. For receiving the liquid into the cylinder 2, the piston 3 is moved down to the descent position (B) of FIG. 1.

When a predetermined quantity of the liquid is filled in the cylinder 2, the valve plug 16 is slightly moved up from the valve seat 15 so that neither the valve 18 nor the valve 19 seats on the valve seats 14 and 15, respectively, to remain in a middle position between the valve seats 14 and 15. In this state, the piston 3 is moved up by the piston rod 5.

By the upward movement of the piston 3, the liquid in the cylinder 2 is pushed up and fed toward the three-way valve 10 from the inflow and outflow port 12. At this time, the valve plug 16 of the three-way valve 10 remains in the middle position, as mentioned above, so that the inflow and outflow port 12 communicates with both of the inflow port 11 and the outflow port 13. Also, the outflow port 13 is closed by the check valve 31 so that the liquid that has been previously supplied remains in the outflow port 13. Hence, air or bubbles remaining in or on the upper surface portion of the liquid in the cylinder 2 or in the outflow port 13 are brought back to the inflow port 11 to be discharged (escape) therefrom as the piston 3 is moved up. In other words, the three-way valve 10 is arranged at the upper end of the cylinder 2 so that any air bubbles in the liquid in the cylinder rise toward the three-way valve and escape through the inflow port 11 when the valve 10 is opened accordingly.

When the air or bubbles in or on the surface portion of the liquid is discharged to the inflow port 11 side from within the cylinder 2, the valve plug 16 of the three-way valve 10 is moved further up so that the valve 18 seats on the valve seat 14 and the communication between the inflow and outflow port 12 and the inflow port 11 is closed. Thus, when the piston 3 is further moved up in the cylinder 2, the liquid in the cylinder 2 flows toward the outflow port 13 to be supplied into the pouring port 30 shown in FIG. 2.

The supply pressure of the liquid supplied to the pouring port 30 side by the upward movement of the piston 3 pushes down the valve plug 32 against the urging force of the spring 36 so that the check valve 31 is opened and a predetermined quantity of the liquid fed by the piston 3 is filled into the liquid container. When the upward movement of the piston 3 finishes and the supply pressure of the liquid lowers, the check valve 31 is closed by the urging force of the spring 36 to thereby intercept the outflow of the liquid and prevent the liquid from dropping. As the bubbles in the liquid to be filled in the liquid container are removed by the operation of the three-way valve 10 at the initial stage of the upward movement of the piston 3, the predetermined quantity of the liquid without bubbles can be filled into the liquid container.

When the discharge of the liquid in the cylinder 2 finishes, the piston 3 is moved down to the descent position (B) and the wash liquid flows in from the wash liquid inflow pipe 20 for washing the connecting link 4 and the upper and lower surface portions thereof below the piston 3. After being used for the wash, the wash liquid is discharged from the wash liquid outflow pipe 21.

The above steps are repeated and the predetermined quantity of liquid is supplied into each of the liquid containers from the cylinder 2 by the operation of the piston 3.

In the above, while the present invention has been described based on the liquid filling device of the embodiment according to the present invention, it is a matter of course that the invention is not limited to the embodiment as illustrated and described. For example, the three-way valve or the check valve as used in the present invention is not limited to the one having the structure as illustrated.

Also, while the illustrated embodiment comprises the structure for washing the portion below the piston 3, if no such wash is needed according to the kind of filling liquid to be treated, then the structure for the wash can be omitted.

What is claimed is:

1. A liquid filling device comprising:

a liquid container for receiving a liquid;

a cylinder having an upper end and a lower end; and a three-way valve having an inflow port, an inflow/outflow port connected to said cylinder, and an outflow port, said three-way valve being arranged at said upper end of said cylinder so that air bubbles within the liquid in said cylinder rise toward said three-way valve and escape through said inflow port when said three-way valve is opened accordingly, said three-way valve being connected between said liquid container and said cylinder so as to control a flow of the liquid from a liquid source into said cylinder and from said upper end of said cylinder into said liquid container.

2. The liquid filling device of claim 1, further comprising:

a pouring port between said three-way valve and said liquid container such that the liquid flowing from said upper end of said cylinder into said liquid container via said three-way valve flows through said pouring port; and a check valve upstream of said pouring port and operable to be opened by a predetermined pressure of the liquid flowing from said upper end of said cylinder.

3. The liquid filling device of claim 2, wherein said pouring port is located downstream of said outflow port.

4. The liquid filling device of claim 1, wherein said three-way valve includes:

a first valve seat at said inflow port;

a second valve seat at said outflow port; and a valve plug having a first valve and a second valve, said three-way valve being operable to be placed in:

a first position, wherein said first valve seats against said first valve seat so as to prevent a flow of the liquid from said cylinder and said outflow port through said inflow port;

a second position, wherein said second valve seats against said second valve seat so as to prevent a flow of the liquid from said cylinder and said inflow port through said outflow port; and an intermediate position between said first position and said second position, wherein said first valve is not seated against said first valve seat and said second valve is not seated against and said second valve seat so as to allow flow between said outflow port, said inflow port, and said cylinder.

5. The liquid filling device of claim 1, wherein said cylinder includes a piston operable to push the liquid out of said cylinder and through said three-way valve.

6. The liquid filling device of claim 1, further comprising a wash liquid inflow pipe and a wash liquid outflow pipe both connected to said lower end of said cylinder.

7. A liquid filling method using said liquid filling device of claim 1, comprising:

filling said cylinder with the liquid by flowing the liquid through said inflow port of said three-way valve;

after filling said cylinder with the liquid, placing said three-way valve in an intermediate position such that both said inflow port and said outflow port are opened so as to be able to communicate with an interior of said cylinder via said inflow/outflow port;

while said three-way valve is in the intermediate position, pushing a portion of the liquid in said cylinder out of said cylinder and through said inflow port of said three-way valve; and after said pushing of the portion of the liquid, placing the three-way valve in a position so as to close said inflow port and feed a remaining portion of the liquid in said cylinder into said liquid container.

8. The liquid filling method of claim 7, further comprising:

arranging a pouring port between said three-way valve and said liquid container, and arranging a check valve between said three-way valve and said pouring port; and setting said check valve to open when a pressure of the liquid in said cylinder reaches a predetermined level after said placing of the three-way valve in the position so as to close said inflow port.

* * * * *